US005682025A

United States Patent [19]

Hohmann et al.

[11] Patent Number: 5,682,025

[45] Date of Patent: Oct. 28, 1997

[54] LOAD ALTERNATION LOADING DEVICE

[76] Inventors: Jörg Hohmann, Hubertusweg 11; Frank Hohmann, Beethovenstrasse 9, both of D-59581 Warstein, Germany

[21] Appl. No.: 591,574

[22] PCT Filed: Jul. 23, 1994

[86] PCT No.: PCT/EP94/02444

§ 371 Date: Jan. 26, 1996

§ 102(e) Date: Jan. 26, 1996

[87] PCT Pub. No.: WO95/03592

PCT Pub. Date: Feb. 2, 1995

[51] Int. Cl.[6] ..... B61L 1/16; G06M 7/00

[52] U.S. Cl. ..... 235/98 R; 235/98 B

[58] Field of Search ..... 235/98 R, 98 B, 235/103

[56] References Cited

U.S. PATENT DOCUMENTS

| | | | |
|---|---|---|---|
| 3,186,311 | 6/1965 | Carlson . | |
| 3,703,629 | 11/1972 | Hanbicki | 235/98 |
| 3,843,047 | 10/1974 | Otsuka et al. . | |
| 4,041,282 | 8/1977 | Uchida et al. | 235/98 R |
| 4,322,966 | 4/1982 | Golabek | 73/7 |
| 4,993,259 | 2/1991 | LaFountain | 73/168 |
| 5,538,256 | 7/1996 | Rinne | 277/1 |

FOREIGN PATENT DOCUMENTS

| | | |
|---|---|---|
| 0224467 | 6/1987 | European Pat. Off. . |
| 306161 | 6/1918 | Germany . |
| 3512568 | 10/1986 | Germany . |
| 4324888 | 2/1995 | Germany . |
| 588743 | 6/1977 | Switzerland . |

*Primary Examiner*—Michael L. Gellner
*Assistant Examiner*—Daniel Chapik
*Attorney, Agent, or Firm*—Robert W. Becker & Associates

[57] ABSTRACT

A load alternation counting device for an actuation device that is periodically hydraulically loaded has a cylinder and a piston sealingly positioned within the cylinder and axially displaceable therein. A pressure connector is provided for connecting the cylinder to a hydraulic loading device of the actuation device such that the piston is axially loaded when hydraulic loading of the actuation device occurs. A counter is switchable by an axial displacement of the piston within the cylinder. A spring for biasing the piston in a direction away from the counter is provided. The spring has a spring force such that switching of the counter by the axial displacement of the piston occurs only when a preset hydraulic pressure is surpassed.

6 Claims, 1 Drawing Sheet

LOAD ALTERNATION LOADING DEVICE

BACKGROUND OF THE INVENTION

The invention relates to load alternation counting device of an actuation device which is periodically pressure loaded, especially of a hydraulically operated screw driving cylinder. Screw driving cylinders have the function to deliver an exactly preset preclamping force onto a screw bolt in order to be able to fasten or release a nut screwed onto the screw bolt. For this purpose, the screw driving cylinder is threaded onto the thread projecting above a nut and subsequently the screw driving cylinder is loaded with hydraulic pressure. This has the consequence that the screw bolt is tensioned by lengthening. The forces applied to the screw bolt are extremely high so that the screw driving cylinder and its individual parts are subjected to a great load. In order to prevent that these highly loaded individual parts break during tensioning of the screw bolt, because, due to surpassing the number of load alternation permissible for these parts, fatigue fracture occurs, it is desired to exchange individual parts that are at risk for fatigue fracture before such fatigue fracture occurs. This is also true for the timely exchange of other parts subjected to wear, for example, gaskets.

In German published document 35 12 568 a stroke counter for reciprocating parts such as piston rods, press rams etc. is disclosed which comprises a sensor arrangement that senses the moved parts passing it. The sensor arrangement is comprised of two sensors spaced apart in the direction of movement which are both positioned within the stroke length. They cooperate with an evaluation circuit connected thereto which operates such that it allows passage of the initial signal of one of the sensors for counting the strokes but only when the initial signal of the other sensor has been received before.

This arrangement serves to provide a reliable counting of strokes even when the strokes due to variations of the operational conditions of the reciprocating part fluctuate, for example, due to changing frictional conditions or differently sized loads which are driven by the part. For this purpose, the two sensors of the sensor arrangement are arranged at a distance from the two stroke length ends in a range of a working stroke which will be definitely passed even when fluctuations of the operational conditions are present. In this manner no stroke will be lost for counting. Since this known stroke counter does not detect load conditions, but is exclusively designed to count strokes even though the stroke length may vary, strokes without load are also counted with this known stroke counter which, with respect to monitoring fatigue fractures or wear of gaskets, are meaning less. For this reason, the known stroke counter is not very suitable for load alternation counting devices of actuating devices of the aforementioned kind because with this stroke counter more strokes than necessary are counted for monitoring exchanging of highly loaded individual parts in order to prevent fatigue fracture so that when using the known stroke counter an exchange of these parts will be preformed unnecessarily prematurely.

The invention has the object to provide a load alternation counting device which counts only the load conditions which are relevant for exchanging parts that are at risk for fatigue fracture in order to have the possibility to exchange after a preset number of load alternations certain highly loaded parts.

Based on this object, a load alternation counting device is suggested that inventively comprises a cylinder connected to the pressure source of the actuating device for pressure loading, a piston arranged sealingly and displaceably within the cylinder, and a counter which is switched by the axial piston movement. The counter is coupled with the piston by a mechanism which transfers the linear movement of the piston into timed rotational movement of the counter via a spring element that is designed according to the piston diameter and the hydraulic pressure.

The load alternation counting device for an actuation device that is periodically hydraulically loaded according to the present invention is primarily characterized by: a cylinder;

a piston sealingly positioned within the cylinder and axially displaceable therein;

a pressure connector for connecting the cylinder to a means for hydraulically loading the actuation device such that the piston is axially loaded when hydraulic loading of the actuation device occurs;

a counter switchable by an axial displacement of the piston within the cylinder; and a spring for biasing the piston in a direction away from the counter, wherein the spring has a spring force such that switching of the counter by the axial displacement of the piston occurs only when a preset hydraulic pressure is surpassed.

Preferably, the piston has an end face proximal to the counter. The end face has a V-groove. The counter has a wedge-shaped follower matching the V-groove and rotated relative to the V-groove. The follower is rotated by the axial displacement of the piston against the spring force of the spring and the counter is switched by one count.

Advantageously, the follower is rotated relative to the V-groove by approximately 36°. The counter comprises an elastic ratchet arrangement for rotation.

In a preferred embodiment, the cylinder is a housing with an axial bore. The piston has a first and a second piston part, wherein the first piston part is sealingly guided within the axial bore of the housing and wherein the piston further comprises a collar located between the first and the second piston parts. The housing has a first recess positioned axially adjacent to the axial bore and a second recess positioned adjacent to the first recess remote from the axial bore. The second piston part is positioned in the first recess and the collar, in a rest position of the piston, rests at a first surface of the first recess. The second piston part is provided with the V-groove, is guided within the first recess coaxially to the first piston part, and is secured against rotation. The counter is positioned in the second recess coaxially to the second piston part. The second recess has a window through which the counter is readable.

The spring is preferably supported at the collar and a second surface of the recess opposite the first surface.

Expediently, the first recess has a lateral opening for inserting the spring. The first and the second surfaces extend parallel to one another. The housing has a coaxial bore connecting the first and the second recesses and an end face with an insertion opening opposite the coaxial bore for inserting the second piston part into the first recess and for inserting the counter into the second recess. The second piston part has an axial groove and a screw extends radially into the housing and engages the axial groove for preventing rotation of the second piston part.

With the inventive load alternation counting device the periodic pressure loading of the actuating device, which is to be monitored, is used in order to displace the piston sealingly arranged within the cylinder each time. The axial piston movement effects a switching of the counter so that each pressure loading of the actuating device the counter is switched, for example, each time when screw bolt is tensioned with the screw driving cylinder the.

Preferably, the piston can have a V-groove at the end face facing the counter and the counter is provided with a wedge-shaped follower which is positioned so as to be rotated relative to the V-groove so that the wedge-shaped follower is further rotated by each axial movement of the piston by one count of the counter. The switching of the counter can be realized in an especially simple manner by the axial piston movement when the wedge-shaped follower is rotated by approximately 36° relative to the V-groove which corresponds to a division by 10 of the circumference of a counter disk for the counter units of the counter. The counter is rotated via an elastic ratched mechanism. In this manner, the single digit disk of the counter is rotated for each stroke of the piston by one count and is returned, when the piston returns into its initial position after pressure release under the force of the spring by approximately 36° so that for the next piston stroke a further switching by one count is effected.

Because of the high pressures the inventive load alternation counting device comprises a massive single-piece housing. In order to be able to preform a simple assembly, the piston can be of a two-part construction whereby one part is sealingly guided in the bore of the housing and rests with a collar at a surface of a recess, while the other part that has the V-groove is coaxially rotationally secured within the housing and arranged coaxially within a further recess relative to the counter which can be read through a lateral window. It is possible to arrange a spring element between the collar and one housing surface of the recess which returns the piston into its initial position when pressure is relieved. Especially, the spring element relative to the piston surface can be sized such that the counter is actuated only at a certain predetermined pressure.

The housing recess in which the second part of the piston is guided, may have a lateral opening for insertion of the pressure spring and may have parallel end surfaces for abutment of the collar and the pressure spring. Furthermore, the housing recess of the counter may have an opening at the end face and a coaxial bore for insertion of the second part of the piston and of the counter, and the second part of the piston can be rotationally secured by a screw or a pin extending radially into a longitudinal groove.

The inventive load alternation counting device provides an autonomous unit and is thus especially advantageous also with respect to retrofitting already existing screw driving cylinders.

BRIEF DESCRIPTION OF THE DRAWINGS

The invention will be explained in detail in the following with the aid of an embodiment represented in the drawing. It is shown in the drawing.

DESCRIPTION OF PREFERRED EMBODIMENTS

The inventive load alternation counting device comprises a massive parallelepipedal housing 1 that has a longitudinal bore 2 which serves as a cylinder bore. At transverse bore 3 serves as a pressure connection to a periodically pressure-loaded actuation device, especially to a hydraulically operated screw driving cylinder (not represented in detail) for tightening and loosening of large screws.

Figure 1:
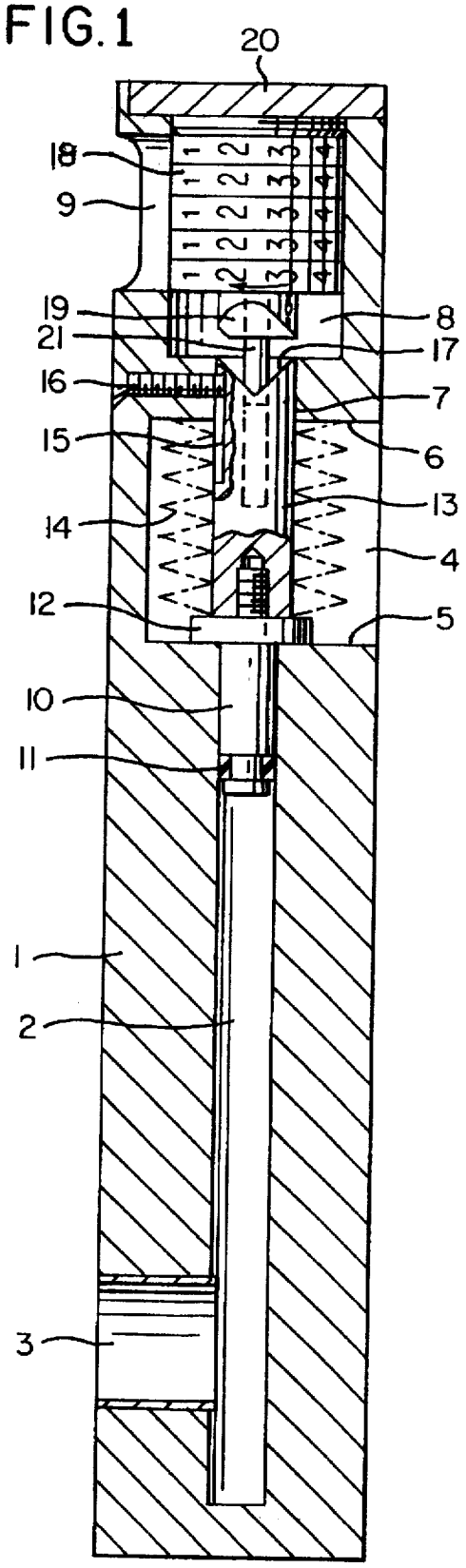
FIG. 1 A longitudinal section of the load alternation counting device in the rest position without pressure load.

A recess 4 is machined laterally in the housing 1 and has parallel end surfaces 5, 6 which extend perpendicularly to the axis of the longitudinal bore 2. The longitudinal bore 2 continues as a coaxial bore 7 which has a transition into an enlarged axial bore which provides a recess 8 for the counter 18 to be inserted therein. The recess is provided with a lateral window 9 for reading the counter 18. In the longitudinal bore 2 a first piston part 10 is guided and sealed by a seal 10 whereby in the rest position represented in FIG. 1 a collar 12 of the first piston part 10 rest at the end surface 5. A second piston part 13 which is screwed to the first piston part 10, penetrates coaxially to the first piston part 10 the recess 4 and is guided through the bore 7. This second piston part 13 is surrounded by a pressure spring 14 which is supported with one end at the collar 12 and with the other end at the end surface 6 of the recess 4. This pressure spring 14 serves to guide the piston parts 10 and 13 upon pressure relief of the bore 2.

The piston part 13 is guided within the housing 1 so as to be rotationally secured. For this purpose, the piston part 13 has a longitudinal groove 15 which is radially engaged by a screw 16.

A V-groove 17 is arranged at the end face of the piston part 13. The counter 18 comprises a wedge-shaped follower 19 coaxially positioned to the V-groove 17 and cooperating with the V-groove 17. The counter 18 is screwed with a flange 20 to the housing 1. The guide pin 21 at the wedge-shaped follower 19 engages a bore of the piston part 13 and serves for guiding the wedge-shaped follower 19.

Figure 2:
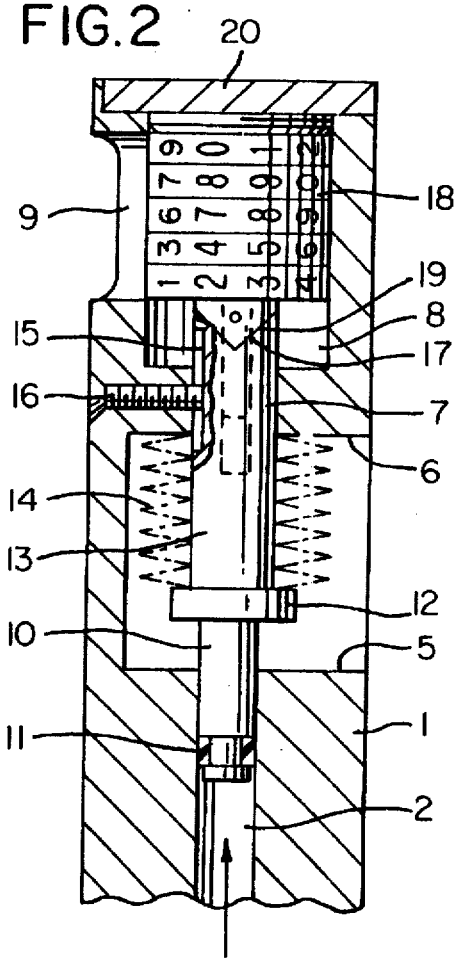
FIG. 2 A partial longitudinal section of the load alternation counting device upon loading.

The wedge-shaped follower 19 is rotated relative to the V-groove 17 due to the finishing tolerances by approximately 36°, preferably a little more than 36°, in order to achieve with reliability a switching of the single digit disc of the counter by one count. When the bore 2 is pressure-loaded via the transverse bore 3, i.e., when the non-represented screw driving cylinder is hydraulically pressurized for clamping a screw bolt, the piston part 1 is displaced with the piston part 13 into the position represented in FIG. 2. This results in a rotation of the wedge-shaped follower 19 by approximately 36° and thus a switching of the single digit disc of the counter by one count. When after pressure relief of teh bore 2 the piston parts 10, 13 have returned into the position represented in FIG. 1, the wedge-shaped follower 19 is returned by a spring within the counter 18 into the position represented in FIG. 1 whereby the single digit disc and the other discs of the counter remain in their position because the wedge-shaped follower 19 is coupled to the counter via an elastic ratchet mechanism. Thus, the next counting step by pressure loading of the bore can take place.

Figure 3:
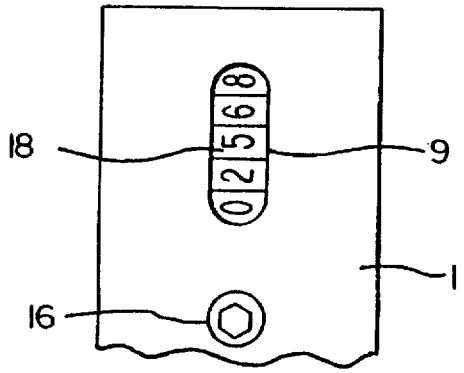
FIG. 3 Partial view of the load alternation counting device with representation of the counter in the window of the housing.

In FIG. 3 it is illustrated how the counter 18 can be read through the window 9 which optionally is provided with a protective glass pane.

For mounting the load alternation counting device first the piston part 10 with its seal 11 is introduced into the bore 2. This bore is accessible via the recess 4 from the side. Subsequently, the pressure spring 14 is also introduced from the side into the recess 4. This pressure spring can optionally be surrounded by a protective coating and can be embodied as a cylindrical coil spring or a plate spring packet or a rubber block.

Subsequently, the second piston part 13 is introduced from the end face of the housing 1 through the recess 8 into the bore 7 and is threaded onto the first piston part 10. In the position represented in FIG. 1, the piston part 13 is rotationally secured by threading the screw 16 that engages the groove 15. Finally, the counter 18 is also inserted from the end face of the housing 1 into the recess 8 and is threaded with a flange 20 arranged at a counter 18 to the housing 1. Now it is only necessary to connect the load alternating counting device via the transverse bore 13 to the pressure-loaded actuating device, especially a hydraulic screw driving cylinder in order to be operational.

The present invention is, of course, in no way restricted to the specific disclosure of the specification and drawings, but also encompasses any modifications within the scope of the appended claims.

We claim:

1. A load alternation counting device for an actuation device that is periodically hydraulically loaded, said load alternation counting device comprising:

a cylinder;

a piston sealingly positioned within said cylinder and axially displaceable therein;

a pressure connector for connecting said cylinder to a means for hydraulically loading the actuation device such that said piston is axially loaded when hydraulic loading of the actuation device occurs;

a counter switchable by an axial displacement of said piston within said cylinder; and a spring for biasing said piston in a direction away from said counter, wherein said spring has a spring force such that switching of said counter by the axial displacement of said piston occurs only when a preset hydraulic pressure is surpassed.

2. A load alternation counting device according to claim 1, wherein:

said piston has an end face proximal to said counter;

said end face has a V-groove; and said counter has a wedge-shaped follower matching said V-groove and rotated relative to said V-groove;

said follower is rotated by the axial displacement of said piston against the spring force of said spring and said counter is switched by one count.

3. A load alternation counting device according to claim 2, wherein:

said follower is rotated relative to said V-groove by approximately 36°; and said counter comprises an elastic ratchet arrangement for rotation.

4. A load alternation counting device according to claim 3, wherein:

said cylinder is a housing with an axial bore;

said piston has a first and a second piston part, said first piston part sealingly guided within said axial bore of said housing;

said piston further comprises a collar located between said first and said second piston parts;

said housing has a first recess positioned axially adjacent to said axial bore and a second recess positioned adjacent to said first recess remote from said axial bore;

said second piston part is positioned in said first recess and said collar, in a rest position of said piston, rests at a first surface of said first recess;

said second piston part is provided with said V-groove, is guided within said first recess coaxially to said first piston part, and is secured against rotation;

said counter is positioned in said second recess coaxially to said second piston part; and said second recess has a window through which said counter is readable.

5. A load alternation counting device according to claim 4, wherein said spring is supported at said collar and a second surface of said recess opposite said first surface.

6. A load alternation counting device according to claim 5, wherein:

said first recess has a lateral opening for inserting said spring;

said first and said second surfaces extend parallel to one another;

said housing has a coaxial bore connecting said first and said second recesses and an end face with an insertion opening opposite said coaxial bore for inserting said second piston part into said first recess and for inserting said counter into said second recess;

said second piston part has an axial groove; and a screw extends radially into said housing and engages said axial groove for preventing rotation of said second piston part.

* * * * *